US010927303B2

(12) United States Patent
Choi et al.

(10) Patent No.: US 10,927,303 B2
(45) Date of Patent: Feb. 23, 2021

(54) METHODS FOR IMPROVED QUENCH TOWER DESIGN

(71) Applicant: SUNCOKE TECHNOLOGY AND DEVELOPMENT LLC, Lisle, IL (US)

(72) Inventors: Chun Wai Choi, Chicago, IL (US); Rajat Kapoor, Naperville, IL (US); John Francis Quanci, Haddonfield, NJ (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

(21) Appl. No.: 15/014,547

(22) Filed: Feb. 3, 2016

(65) Prior Publication Data

US 2016/0222297 A1 Aug. 4, 2016

Related U.S. Application Data

(62) Division of application No. 13/843,166, filed on Mar. 15, 2013, now Pat. No. 9,273,250.

(51) Int. Cl.
*C10B 39/08* (2006.01)
*C10B 41/00* (2006.01)
(Continued)

(52) U.S. Cl.
CPC ..... *C10B 39/08* (2013.01); *C10B 41/00* (2013.01); *C10B 39/00* (2013.01); *C10B 39/04* (2013.01)

(58) Field of Classification Search
CPC ..... C10B 39/00; C10B 39/02; C10B 39/04; C10B 39/08; C10B 39/14; C10B 39/06;
(Continued)

(56) References Cited

U.S. PATENT DOCUMENTS 425,797 A 4/1890 Hunt
469,868 A 3/1892 Osbourn
(Continued)

FOREIGN PATENT DOCUMENTS

CA 1172895 8/1984
CA 2775992 5/2011
(Continued)

OTHER PUBLICATIONS

Kerlin, Thomas W.. (1999). Practical Thermocouple Thermometry—1.1 The Thermocouple. ISA. Online version available at: https://app.knovel.com/hotlink/pdf/id:kt007XPTM3/practical-thernnocouple/the-thermocouple.*

(Continued)

*Primary Examiner* — Jonathan Luke Pilcher
(74) *Attorney, Agent, or Firm* — Perkins Coie LLP

(57) ABSTRACT

The present technology describes methods and systems for an improved quench tower. Some embodiments improve the quench tower's ability to recover particulate matter, steam, and emissions that escape from the base of the quench tower. Some embodiments improve the draft and draft distribution of the quench tower. Some embodiments include one or more sheds to enlarge the physical or effective perimeter of the quench tower to reduce the amount of particulate matter, emissions, and steam loss during the quenching process. Some embodiments include an improved quench baffle formed of a plurality of single-turn or multi-turn chevrons adapted to prevent particulate matter from escaping the quench tower. Some embodiments include an improved quench baffle spray nozzle used to wet the baffles, suppress dust, and/or clean baffles. Some embodiments include a quench nozzle that can fire in discrete stages during the quenching process.

17 Claims, 8 Drawing Sheets

(51) Int. Cl.
*C10B 39/04* (2006.01)
*C10B 39/00* (2006.01)

(58) Field of Classification Search
CPC .... B01D 2247/107; B61D 7/32; B61D 11/02; B61D 9/00; B61D 9/06
See application file for complete search history.

(56) References Cited

U.S. PATENT DOCUMENTS 845,719 A 2/1907 Schniewind
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Kiaiber
1,677,973 A * 7/1928 Marquard ..... C10B 39/04 201/39
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A * 3/1932 Becker ..... C10B 39/08 201/39
1,947,499 A 2/1934 Schrader et al.
1,955,962 A 4/1934 Jones
2,075,337 A 3/1937 Burnaugh
2,141,035 A 12/1938 Daniels
2,195,466 A 4/1940 Otto
2,394,173 A 2/1946 Harris et al.
2,424,012 A 7/1947 Bangham et al.
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
3,015,893 A 1/1962 McCreary
3,033,764 A 5/1962 Hannes
3,224,805 A 12/1965 Clyatt
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobi et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,984,289 A 10/1976 Sustarsic et al.
4,004,702 A 1/1977 Szendroi
4,004,983 A 1/1977 Pries
4,025,395 A * 5/1977 Ekholm ..... C10B 39/04 201/39
4,040,910 A 8/1977 Knappstein et al.
4,045,299 A 8/1977 MacDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Carimboli
4,124,450 A 11/1978 MacDonald
4,135,948 A 1/1979 Mertens et al.
4,141,796 A 2/1979 Clark et al.
4,145,195 A 3/1979 Knappstein et al.
4,147,230 A 4/1979 Ormond et al.
4,162,546 A 7/1979 Shortell et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A * 4/1981 Porter ..... C10B 39/08 201/39
4,268,360 A 5/1981 Tsuzuki et al.
4,271,814 A 6/1981 Lister
4,284,478 A * 8/1981 Brommel ..... C10B 39/08 202/227
4,285,772 A 8/1981 Kress
4,287,024 A 9/1981 Thompson
4,289,584 A 9/1981 Chuss et al.
4,289,585 A * 9/1981 Wagener ..... C10B 39/08 202/227
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A * 8/1982 Schwartz ..... C10B 39/04 201/39
4,353,189 A 10/1982 Thiersch et al.
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.

(56) References Cited

U.S. PATENT DOCUMENTS 4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,704,195 A 11/1987 Janicka et al.
4,720,262 A 1/1988 Durr et al.
4,724,976 A 2/1988 Lee
4,726,465 A 2/1988 Kwasnik et al.
4,793,931 A 12/1988 Doyle et al.
4,824,614 A 4/1989 Jones et al.
4,889,698 A 12/1989 Moller et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,423,152 A 6/1995 Kolvek
5,480,594 A 1/1996 Wilkerson et al.
5,542,650 A 8/1996 Abel et al.
5,622,280 A 4/1997 Mays et al.
5,659,110 A 8/1997 Herden et al.
5,670,025 A 9/1997 Baird
5,687,768 A 11/1997 Albrecht et al.
5,715,962 A 2/1998 McDonnell
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,913,448 A 6/1999 Mann et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,152,970 B2 4/2012 Barkdoll et al.
8,236,142 B2 8/2012 Westbrook
8,266,853 B2 9/2012 Bloom et al.
8,398,935 B2 3/2013 Howell et al.
8,409,405 B2 4/2013 Kim et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,193,915 B2 11/2015 West et al.
9,243,186 B2 1/2016 Quanci et al.
9,249,357 B2 2/2016 Quanci et al.
10,323,192 B2 6/2019 Quanci et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2005/0087767 A1 4/2005 Fitzgerald et al.
2006/0102420 A1 5/2006 Huber et al.
2006/0149407 A1 7/2006 Markham et al.
2007/0116619 A1 5/2007 Taylor et al.
2007/0251198 A1 11/2007 Witter
2008/0028935 A1 2/2008 Andersson
2008/0169578 A1 7/2008 Crane et al.
2008/0179165 A1 7/2008 Chen et al.
2008/0257236 A1 10/2008 Green
2008/0271985 A1 11/2008 Yamasaki
2008/0289305 A1 11/2008 Girondi
2009/0007785 A1 1/2009 Kimura et al.
2009/0152092 A1 6/2009 Kim et al.
2009/0162269 A1 6/2009 Barger et al.
2009/0217576 A1 9/2009 Kim et al.
2009/0283395 A1 11/2009 Hippe
2010/0095521 A1 4/2010 Kartal et al.
2010/0106310 A1 4/2010 Grohman
2010/0113266 A1 5/2010 Abe et al.
2010/0115912 A1 5/2010 Worley
2010/0181297 A1 7/2010 Whysail
2010/0196597 A1 8/2010 Di Loreto
2010/0276269 A1 11/2010 Schuecker et al.
2010/0287871 A1 11/2010 Bloom et al.
2010/0300867 A1 12/2010 Kim et al.
2010/0314234 A1 12/2010 Knoch et al.
2011/0048917 A1 3/2011 Kim et al.
2011/0088600 A1 4/2011 McRae
2011/0120852 A1 5/2011 Kim
2011/0144406 A1 6/2011 Masatsugu et al.
2011/0168482 A1 7/2011 Merchant et al.
2011/0174301 A1 7/2011 Haydock et al.
2011/0192395 A1 8/2011 Kim
2011/0198206 A1 8/2011 Kim et al.
2011/0223088 A1 9/2011 Chang et al.
2011/0253521 A1 10/2011 Kim
2011/0284360 A1* 11/2011 Westbrook ..... C10B 33/003 201/8
2011/0291827 A1 12/2011 Baldocchi et al.

(56) References Cited

U.S. PATENT DOCUMENTS

| | | | | |
|---|---|---|---|---|
| 2011/0313218 | A1 | 12/2011 | Dana | |
| 2011/0315538 | A1 | 12/2011 | Kim et al. | |
| 2012/0024688 | A1 | 2/2012 | Barkdoll | |
| 2012/0030998 | A1 | 2/2012 | Barkdoll et al. | |
| 2012/0125709 | A1 | 5/2012 | Merchant et al. | |
| 2012/0152720 | A1 | 6/2012 | Reichelt et al. | |
| 2012/0180133 | A1 | 7/2012 | Al-Harbi et al. | |
| 2012/0228115 | A1 | 9/2012 | Westbrook | |
| 2012/0247939 | A1 | 10/2012 | Kim et al. | |
| 2012/0305380 | A1 | 12/2012 | Wang et al. | |
| 2013/0020781 | A1 | 1/2013 | Kishikawa | |
| 2013/0045149 | A1 | 2/2013 | Miller | |
| 2013/0216717 | A1 | 8/2013 | Rago et al. | |
| 2013/0220373 | A1 | 8/2013 | Kim | |
| 2013/0306462 | A1 | 11/2013 | Kim et al. | |
| 2014/0033917 | A1 | 2/2014 | Rodgers et al. | |
| 2014/0039833 | A1 | 2/2014 | Sharpe, Jr. et al. | |
| 2014/0048402 | A1 | 2/2014 | Quanci et al. | |
| 2014/0061018 | A1 | 3/2014 | Sarpen et al. | |
| 2014/0083836 | A1 | 3/2014 | Quanci et al. | |
| 2014/0182195 | A1 | 7/2014 | Quanci et al. | |
| 2014/0182683 | A1 | 7/2014 | Quanci et al. | |
| 2014/0183023 | A1 | 7/2014 | Quanci et al. | |
| 2014/0183024 | A1 | 7/2014 | Chun et al. | |
| 2014/0183026 | A1 | 7/2014 | Quanci et al. | |
| 2014/0208997 | A1 | 7/2014 | Alferyev et al. | |
| 2014/0224123 | A1 | 8/2014 | Walters | |
| 2014/0262139 | A1 | 9/2014 | Choi et al. | |
| 2014/0262726 | A1 | 9/2014 | West et al. | |
| 2015/0122629 | A1* | 5/2015 | Freimuth ..... | B01D 45/10 201/39 |
| 2015/0219530 | A1 | 8/2015 | Li et al. | |
| 2015/0247092 | A1 | 9/2015 | Quanci et al. | |
| 2015/0328576 | A1 | 9/2015 | Quanci et al. | |
| 2015/0287026 | A1 | 10/2015 | Quanci et al. | |
| 2016/0026193 | A1 | 1/2016 | Rhodes et al. | |
| 2016/0032193 | A1 | 2/2016 | Sarpen et al. | |
| 2016/0048139 | A1 | 2/2016 | Samples et al. | |
| 2016/0060532 | A1 | 3/2016 | Quanci et al. | |
| 2016/0060533 | A1 | 3/2016 | Quanci et al. | |
| 2016/0060534 | A1 | 3/2016 | Quanci et al. | |
| 2016/0060536 | A1 | 3/2016 | Quanci et al. | |
| 2016/0149944 | A1 | 5/2016 | Obermeier et al. | |
| 2017/0015908 | A1 | 1/2017 | Quanci et al. | |

FOREIGN PATENT DOCUMENTS

| | | | |
|---|---|---|---|
| CA | 2822841 | | 7/2012 |
| CA | 2822857 | | 7/2012 |
| CN | 87212113 | U | 6/1988 |
| CN | 87107195 | A | 7/1988 |
| CN | 2064363 | | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 103468289 | A | 12/2013 |
| CN | 105189704 | A | 12/2015 |
| CN | 106661456 | A | 5/2017 |
| DE | 201729 | C | 9/1908 |
| DE | 212176 | | 7/1909 |
| DE | 1212037 | B | 3/1966 |
| DE | 3231697 | C1 | 1/1984 |
| DE | 3315738 | C2 | 3/1984 |
| DE | 3329367 | C | 11/1984 |
| DE | 3328702 | A1 | 2/1985 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | A1 | 12/2007 |
| DE | 102009031436 | | 1/2011 |
| DE | 102011052785 | | 12/2012 |
| EP | 0126399 | A1 | 11/1984 |
| EP | 0208490 | | 1/1987 |
| EP | 0903393 | A2 | 3/1999 |
| EP | 1538503 | A1 | 6/2005 |
| EP | 2295129 | | 3/2011 |
| FR | 2339664 | | 8/1977 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 11/1975 |
| JP | S59019301 | | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H0649450 | A | 2/1994 |
| JP | H0654753 | U | 7/1994 |
| JP | 06264062 | | 9/1994 |
| JP | 07188668 | | 7/1995 |
| JP | 07216357 | | 8/1995 |
| JP | H07204432 | | 8/1995 |
| JP | H08104875 | A | 4/1996 |
| JP | 08127778 | | 5/1996 |
| JP | H10273672 | A | 10/1998 |
| JP | H11-131074 | | 5/1999 |
| JP | 2000204373 | A | 7/2000 |
| JP | 2001200258 | | 7/2001 |
| JP | 2002106941 | | 4/2002 |
| JP | 2003041258 | | 2/2003 |
| JP | 2003071313 | | 3/2003 |
| JP | 2003292968 | A | 10/2003 |

(56) References Cited

FOREIGN PATENT DOCUMENTS

| | | | |
|---|---|---|---|
| JP | 2003342581 | A | 12/2003 |
| JP | 2005503448 | A | 2/2005 |
| JP | 2005263983 | A | 9/2005 |
| JP | 2006188608 | A | 7/2006 |
| JP | 2007063420 | A | 3/2007 |
| JP | 4101226 | B2 | 6/2008 |
| JP | 2008231278 | A | 10/2008 |
| JP | 2009073864 | A | 4/2009 |
| JP | 2009073865 | A | 4/2009 |
| JP | 2009144121 | | 7/2009 |
| JP | 2010229239 | A | 10/2010 |
| JP | 2010248389 | A | 11/2010 |
| JP | 2012102302 | | 5/2012 |
| JP | 2013006957 | A | 1/2013 |
| JP | 2013510910 | | 3/2013 |
| JP | 2013189322 | A | 9/2013 |
| JP | 2014040502 | A | 3/2014 |
| KR | 1019960008754 | | 10/1996 |
| KR | 1019990054426 | | 7/1999 |
| KR | 20000042375 | A | 7/2000 |
| KR | 100296700 | B1 | 10/2001 |
| KR | 1020050053861 | A | 6/2005 |
| KR | 100737393 | B1 | 7/2007 |
| KR | 100797852 | | 1/2008 |
| KR | 1020110010452 | A | 2/2011 |
| KR | 101314288 | | 4/2011 |
| KR | 20130050807 | | 5/2013 |
| KR | 101318388 | | 10/2013 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO2005023649 | | 3/2005 |
| WO | WO2005115583 | | 12/2005 |
| WO | WO2007103649 | | 9/2007 |
| WO | WO2008034424 | | 3/2008 |
| WO | WO2011000447 | | 1/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |

OTHER PUBLICATIONS

Boyes, Walt. (2003). Instrumentation Reference Book (3rd Edition)—34.7.4.6 Infrared and Thermal Cameras. Elsevier. Online version available at: https://app.knovel.com/hotlink/pdf/id:kt004QMGV6/instrumentation-reference-2/digital-video.*

U.S. Appl. No. 14/959,450, filed Dec. 4, 2015, Quanci et al.

U.S. Appl. No. 14/983,857, filed Dec. 30, 2015, Quanci et al.

U.S. Appl. No. 14/984,489, filed Dec. 30, 2015, Quanci et al.

U.S. Appl. No. 14/986,281, filed Dec. 31, 2015, Quanci et al.

U.S. Appl. No. 14/987,625, filed Jan. 4, 2016, Quanci et al.

ASTM D5341-99(2010)e1, Standard Test Method for Measuring Coke Reactivity Index (CRI) and Coke Strength After Reaction (CSR), ASTM International, West Conshohocken, PA, 2010.

Basset, et al., "Calculation of steady flow pressure loss coefficients for pipe junctions," Proc Instn Mech Engrs., vol. 215, Part C. IMechIE 2001.

Clean coke process: process development studies by USS Engineers and Consultants, Inc., Wisconsin Tech Search, request date Oct. 5, 2011, 17 pages.

Costa, et al., "Edge Effects on the Flow Characteristics in a 90 deg Tee Junction," Transactions of the ASME, Nov. 2006, vol. 128, pp. 1204-1217.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

International Search Report and Written Opinion of International Application No. PCT/US2012/072166; dated Sep. 25, 2013; 11 pages.

JP 03-197588, Inoqu Keizo et al., Method and Equipment for Boring Degassing Hole in Coal Charge in Coke Oven, Japanese Patent (Abstract Only) Aug. 28, 1991.

JP 04-159392, Inoue Keizo et al., Method and Equipment for Opening Hole for Degassing of Coal Charge in Coke Oven, Japanese Patent (Abstract Only) Jun. 2, 1992.

Rose, Harold J., "The Selection of Coals for the Manufacture of Coke," American Institute of Mining and Metallurgical Engineers, Feb. 1926, 8 pages.

U.S. Appl. No. 15/322,176, filed Dec. 27, 2015, West et al.

U.S. Appl. No. 15/443,246, filed Feb. 27, 2017, Quanci et al.

U.S. Appl. No. 15/511,036, filed Mar. 14, 2017, West et al.

Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.

Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.

U.S. Appl. No. 15/139,568, filed Apr. 27, 2016, Quanci et al.

Canadian Office Action in Canadian Application No. 2,896,769, dated Apr. 4, 2016, 4 pages.

Waddell, et al., "Heat-Recovery Cokemaking Presentation," Jan. 1999, pp. 1-25.

Westbrook, "Heat-Recovery Cokemaking at Sun Coke," AISE Steel Technology, Pittsburg, PA, vol. 76, No. 1, Jan. 1999, pp. 25-28.

Yu et al., "Coke Oven Production Technology," Lianoning Science and Technology Press, first edition, Apr. 2014, pp. 356-358.

"Resources and Utilization of Coking Coal in China," Mingxin Shen ed., Chemical Industry Press, first edition, Jan. 2007, pp. 242-243, 247.

U.S. Appl. No. 15/392,942, filed Dec. 28, 2016, Quanci et al.

Canadian Office Action in Canadian Application No. 2,896,769, dated Oct. 26, 2016, 3 pages.

Chinese Office Action in Chinese Application No. 201480003680.0, dated Aug. 1, 2016.

Extended European Search Report in European Application No. 16171700.4, dated Sep. 21, 2016; 7 pages.

Extended European Search Report in European Application No. 14765030.3, dated Sep. 30, 2016, 4 pages.

Extended European Search Report in European Application No. 16171697.2, dated Oct. 13, 2016, 6 pages.

Bloom, et al., "Modular cast block—The future of coke oven repairs," Iron & Steel Technol, AIST, Warrendale, PA, vol. 4, No. 3, Mar. 1, 2007, pp. 61-64.

Examination Report for European Application No. 16171697.2; dated Nov. 28, 2017; 5 pages.

U.S. Appl. No. 15/614,525, filed Jun. 5, 2017, Quanci et al.

"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.

"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 p. 7 pp. 8-11.

(56) References Cited

OTHER PUBLICATIONS

Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
Walker D N et al, "Sun Coke Company's heat recovery cokemaking technology high coke quality and low environmental impact", Revue De Metallurgie-Cahiers D'Informations Techniques, Revue De Metallurgie. Paris, FR, (Mar. 1, 2003), vol. 100, No. 3, ISSN 0035-1563, p. 23.
Chinese Office Action in Chinese Application No. 201480003680.0, dated Mar. 29, 2017.
Examination Report in European Application No. 16171700.4; dated Sep. 21, 2017; 4 pages.
Examination Report for European Application No. 14765030.3; dated Nov. 3, 2017, 6 pages.
U.S. Appl. No. 15/987,860, filed May 23, 2018, Crum et al.
U.S. Appl. No. 16/000,516, filed Jun. 5, 2018, Quanci.
Madias, et al., "A review on stamped charging of coals" (2013). Available at https://www.researchgate.net/publicatoin/263887759_A_review_on_stamped_charging_of_coals.
Metallurgical Code MSDS, ArcelorMittal, May 30, 2011, available online at http://dofasco.arcelormittal.com/-/media/Files/A/Arcelormittal-Canada/material-safety/metallurgical-coke.pdf.
U.S. Appl. No. 16/026,363, filed Jul. 3, 2018, Chun et al.
U.S. Appl. No. 16/047,198, filed Jul. 27, 2018, Quanci et al.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Industrial Furnace Design Handbook, Editor-in-Chief: First Design Institute of First Ministry of Machinery Industry, Beijing: Mechanical Industry Press, pp. 180-183, Oct. 1981.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-contro1.4728/; 8 pages.
U.S. Appl. No. 07/886,804, filed May 22m 1992, now U.S. Pat. No. 5,228,955, titled High Strength Coke Oven Wall Having Gas Flues Therein.
U.S. Appl. No. 13/830,971, filed Mar. 14, 2013, titled Non-Perpendicular Connections Between Coke Oven Uptakes and a Hot Common Tunnel, and Associated Systems and Methods.
U.S. Appl. No. 14/952,267, filed Nov. 25, 2015, titled Systems and Methods for Improving Quenched Coke Recovery.
U.S. Appl. No. 14/959,450, filed Dec. 4, 2015, titled Coke Plant Including Exhaust Gas Sharing.
U.S. Appl. No. 14/865,581, filed Sep. 25, 2015, titled Method and Apparatus for Testing Coal Coking Properties.
U.S. Appl. No. 15/443,246, filed Feb. 27, 2017, titled Coke Oven Charging System.
U.S. Appl. No. 14/587,670, filed Dec. 31, 2014, titled Methods for Decarbonizing Coking Ovens, and Associated Systems and Devices.
U.S. Appl. No. 14/839,493, filed Aug. 28, 2015, titled Method and System for Optimizing Coke Plant Operation and Output.
U.S. Appl. No. 14/839,551, filed Aug. 28, 2015, titled Burn Profiles for Coke Operations.
U.S. Appl. No. 13/830,971, filed Mar. 14, 2013, titled Non-Perpendicular Connections Between Coke Uptakes and a Hot Common Tunnel, and Associated Systems and Methods.
U.S. Appl. No. 15/830,320, filed Dec. 4, 2017, titled Systems and Methods for Improving Quenched Coke Recovery.
U.S. Appl. No. 14/921,723, filed on Oct. 23, 2015, titled Reduced Output Rate Coke Oven Operation With Gas Sharing Providing Extended Process Cycle.
U.S. Appl. No. 14/987,625, filed Jan. 4, 2016, titled Integrated Coke Plant Automation and Optimization Using Advanced Control and Optimization.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Brazilian Examination Report for BrazilianApplication No. BR112015015435-2; dated Jul. 16, 2019; 4 pages.
U.S. Appl. No. 11/367,236, filed Mar. 3, 2006, now U.S. Pat. No. 8,152,970, titled Method and Apparatus for Producing Coke.
U.S. Appl. No. 15/322,176, filed Dec. 27, 2016, titled Horizontal Heat Recovery Coke Ovens Having Monolith Crowns.
U.S. Appl. No. 14/959,450, filed Dec. 4, 2015, now U.S. Pat. No. 10/041,002, titled Coke Plant Including Exhaust Gas Sharing, now U.S. Pat. No. 10,041,002.
U.S. Appl. No. 16/047,198, filed Jul. 27, 2018, titled Coke Plant Including Exhaust Gas Sharing.
U.S. Appl. No. 15/433,246, now U.S. Pat. No. 9,976,089, filed Feb. 27, 2017, titled Coke Oven Charging System.
U.S. Appl. No. 14/587,670, filed Dec. 31, 2014, titled Methods for Decarbonized Coking Ovens, and Associated Systems and Devices.
U.S. Appl. No. 15/392,942, filed Dec. 28, 2016, titled Method and System for Dynamically Charging a Coke Oven.
India First Examination Report in Application No. 570/KOLNP/2015; dated Sep. 19, 2019; 7 pages.
U.S. Appl. No. 16/251,352, filed Jan. 18, 2019, Quanci et al.
U.S. Appl. No. 16/428,014, filed May 31, 2019, Quanci et al.
Examination Report for European Application No. 161717004.4; dated Mar. 13, 2019.
U.S. Appl. No. 16/828,448, filed Mar. 24, 2020, Quanci et al.
U.S. Appl. No. 16/845,530, filed Apr. 10, 2020, Quanci et al.
U.S. Appl. No. 16/704 689, filed Dec. 5, 2019, West et al.
U.S. Appl. No. 16/729 036, filed Dec. 27, 2019, Quanci et at.
U.S. Appl. No. 16/729 053, filed Dec. 27, 2019, Quanci et at.
U.S. Appl. No. 16/729 057, filed Dec. 27, 2019, Quanci et at.
U.S. Appl. No. 16/729 068, filed Dec. 27, 2019, Quanci et at.
U.S. Appl. No. 16/729 122, filed Dec. 27, 2019, Quanci et at.
U.S. Appl. No. 16/729 129, filed Dec. 27, 2019, Quanci et at.
U.S. Appl. No. 16/729 157, filed Dec. 27, 2019, Quanci et at.
U.S. Appl. No. 16/729 170, filed Dec. 27, 2019, Quanci et at.
U.S. Appl. No. 16/729 201, filed Dec. 27, 2019, Quanci et at.
U.S. Appl. No. 16/729 212, filed Dec. 27, 2019, Quanci et at.
U.S. Appl. No. 16/729 219, filed Dec. 27, 2019, Quanci et at.
U.S. Appl. No. 16/735,103, filed Jan. 6, 2020, Quanci et al.
Joseph, B., "A tutorial on inferential control and its applications," Proceedings of the 1999 American Control Conference (Cat. No. 99CH36251), San Diego, CA, 1999, pp. 3106-3118 vol. 5.
Examination Report for European Application No. 14765030.3; dated Nov. 26, 2019; 6 pages.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.

(56) References Cited

OTHER PUBLICATIONS

U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus and Producing Coke.
U.S. Appl. No. 12/403,391, filed Mar. 13, 2009, now U.S. Pat. No. 8,172,930, titled Cleanable in Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/921,723, filed Oct. 23, 2015, titled Reduced Output Rate Coke Oven Operation With Gas Sharing Providing Extended Process Cycle.
U.S. Appl. No. 14/655,204, filed Jun. 24,2015, titled Systems and Methods for Removing Mercury From Emissions.
U.S. Appl. No. 16/000,516, filed Jun. 5, 2018, titled Systems and Methods for Removing Mercury From Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, titled Non-Perpendicular Connections Between Coke Oven Uptakes and a Hot Common Tunnel, and Associated Systems and Methods.
U.S. Appl. No. 13/730,796, filed Dec. 28, 2012, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, titled Coke Ovens Having Monolith Component Construction.
U.S. Appl. No. 16/704,689, filed Dec. 5, 2019, titled Horizontal Heat Recovery Coke Ovens Having Monolith Crowns.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing.
U.S. Appl. No. 16/047,198, filed Jul. 27, 2018, now U.S. Pat. No. 10,611,965, titled Coke Plant Including Exhaust Gas Sharing.
U.S. Appl. No. 16/828,448, filed Mar. 24, 2020, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No.10,053,627.
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, titled Methods for Decarbonizing Coking Ovens, and Associated Systems and Devices.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal beds of Coking Material.
U.S. Appl. No. 14.986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, titled System and Method for Repairing a Coke Oven.
U.S. Appl. No. 16/729,053, filed Dec. 27, 2019, titled Oven Uptakes.
U.S. Appl. No. 16/729,036, filed Dec. 27, 2019, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, titled Methods and Systems for Providing Corrosion Resistant Surfaces in Contaminant Treatment Systems.
U.S. Appl. No. 16,729,068, filed Dec. 27, 2019, titled Systems and Methods for Utilizing Flue Gas.
U.S. Appl. No. 16/729,129, filed Dec. 27, 2019, titled Coke Plant Tunnel Repair and Flexible Joints.
U.S. Appl. No. 16/729,170, filed Dec. 27, 2019, titled Coke Plant Tunnel Repair and Anchor Distribution.

(56) References Cited

OTHER PUBLICATIONS

U.S. Appl. No. 16/729,157, filed Dec. 27, 2019, titled Particulate Detection for Industrial Facilities, and Associated Systems and Methods.
U.S. Appl. No. 16/729,057, filed Dec. 27, 2019, titled Decarbonization of Coke Ovens and Associated Systems and Methods.
U.S. Appl. No. 16/729,212, filed Dec. 27, 2019, titled Heat Recovery Oven Foundation.
U.S. Appl. No. 16/729,219, filed Dec. 27, 2019, titled Spring-Loaded Heat Recovery Oven System and Method.

* cited by examiner

METHODS FOR IMPROVED QUENCH TOWER DESIGN

CROSS-REFERENCE TO RELATED APPLICATIONS

The present application is a divisional of U.S. patent application Ser. No. 13/843,166, filed Mar. 15, 2013, the disclosure of which is incorporated herein by reference in its entirety

TECHNICAL FIELD

The present technology is generally directed to methods and systems for an improved quench tower. More specifically, the various embodiments herein are directed to an improved quench tower design and arrangement that includes one or more sheds attached to the quench tower, a dust suppression system, a baffle design formed of chevrons having multiple turns, and an automated quenching procedure.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for 24 to 48 hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

Coal particles or a blend of coal particles are charged into hot ovens, and the coal is heated in the ovens in order to remove volatile matter ("VM") from the resulting coke. The coking process is highly dependent on the oven design, the type of coal, and conversion temperature used. Typically, ovens are adjusted during the coking process so that each charge of coal is coked out in approximately the same amount of time. Once the coal is fully coked out, the resulting coke may take the form of a substantially intact coke loaf that is then quenched with water or another liquid. Because the coke loaf may stay intact during quenching, the quenching liquid may encounter difficulty penetrating the intact coke loaf. Moreover, an unacceptable amount of coke may be lost during the quenching process. For example, coke may fly out of the container in which it is otherwise contained (i.e., "flied coke") during the quenching process. In addition, an amount of particulate matter may be generated during the quenching process and vented through the quench tower into the atmosphere outside of the quench tower.

These problems of conventional systems lead to myriad disadvantages that lower the overall efficiency of the coking operation. For example, the difficulty of penetrating an intact or partially intact coke loaf may result in increased water usage, longer quench times that can cripple the throughput of the coke plant, excessive moisture levels in the coke, large variations in coke moisture, and increased risk of melting plant equipment if the coke is not cooled rapidly enough. In addition, conventional systems may vent an unacceptable level of particulate matter into the environment, thereby creating a need for more effective environmental controls. These problems may occur in any coking operation but are particularly applicable to stamp charged coking operations, in which the coal is compacted prior to heating. As another example, a large amount of flied coke or particulate matter that escapes the quench tower may lower the efficiency of the coking operation by yielding less coke for screening and loading into rail cars or trucks for shipment at the end of the quenching process. Therefore, a need exists for an improved quench tower that provides a quenching operation that more efficiently penetrates an amount of coke with a quenching liquid, reduces the amount of coke loss due to flied coke, reduces the amount of particulate matter that escapes the quench tower, and reduces the particulate matter, emissions, and steam that escapes the bottom of the quench tower.

DETAILED DESCRIPTION

The present technology is generally directed to methods and systems for an improved quench tower. More specifically, some embodiments are directed to methods and systems that improve the ability of the quench tower to recover particulate matter, steam, and emissions that escape from the base of the quench tower (i.e., improved recovery). Moreover, some embodiments are directed to methods and systems that improve the draft and draft distribution (or "draft distribution profile") of the quench tower. The improved quench tower includes one or more sheds (each having a shed physical perimeter) to enlarge the physical perimeter or the effective physical perimeter of the quench tower to reduce the amount of particulate matter, emissions, and steam loss during the quenching process. Some embodiments are directed to methods and systems for an improved quench baffle design and arrangement formed of a plurality of single chevrons or multi-turn chevrons adapted to prevent particulate matter from escaping the quench tower. Some embodiments are directed to methods and systems for an improved quench baffle spray nozzle design and arrangement that enables one or more quench spray nozzles to wet the baffles prior to quenching, suppress dust during quenching, and/or clean the baffles after quenching. Some embodiments are directed to a quench nozzle design and arrangement that enables the quench nozzles to be fired in one or more discrete stages during the quenching process. Some embodiments are directed to methods and systems for a flied coke reclaim baffle that redirects flied coke into a train car located within the quench tower.

Specific details of several embodiments of the technology are described below with reference to FIGS. 1-7. Other details describing well-known structures and systems often associated with coke making and/or quenching have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-4.

Figure 1:
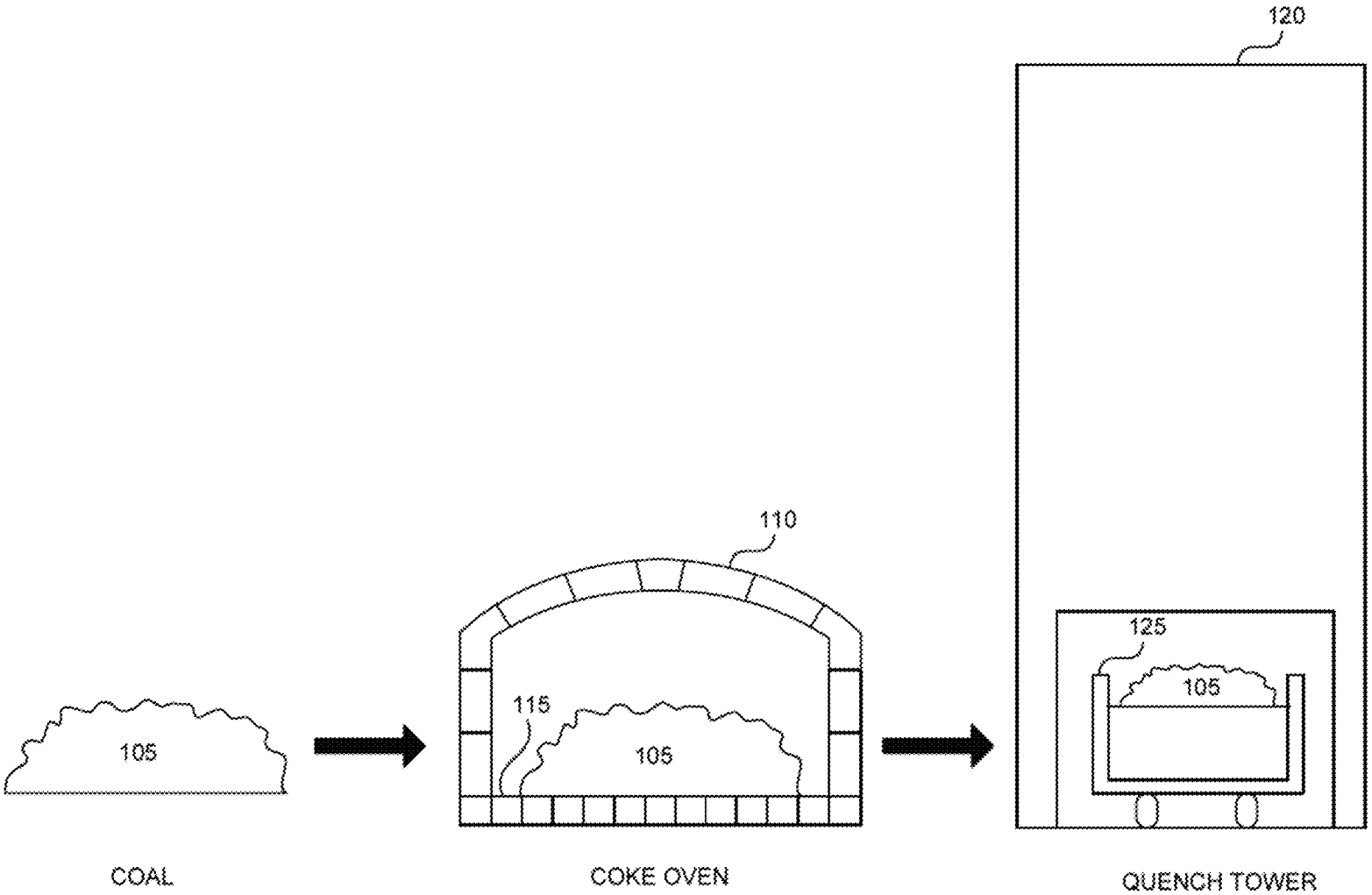
FIG. 1 is a diagram illustrating an overview of a coke making process.

FIG. 1 is a diagram illustrating an overview of a coke making process. A mass of coal 105 is loaded into coke oven 110 and baked at temperatures that typically exceed 2000 degrees Fahrenheit. Once the coal is "coked out" or fully coked, the resulting coke loaf is removed from the oven and transferred to a train car, hot car, quench car, or combined hot car/quench car 125. The coke loaf is then transported to quench tower 120 for quenching. Further details regarding the present invention (including further details regarding the coking process, train cars, hot cars, quench cars, and combined hot car/quench cars) may be found in commonly-assigned U.S. patent application Ser. No. 13/730,796, filed on Dec. 28, 2012, entitled METHODS AND SYSTEMS FOR IMPROVED COKE QUENCHING.

Quench Tower Design and Arrangement

An improved quench tower design is provided herein that maximizes the overall efficiency of the quenching process, particularly as it relates to lowering emissions and particulate matter generated during the quenching process. The improved design maximizes efficiency by expanding the actual perimeter and/or the effective perimeter of the quench tower. As explained in more detail below, the actual perimeter may be expanded through the addition of one or more sheds attached to the sides of the quench tower geometry in order to increase the physical area enclosed by the quench tower. The effective perimeter likewise may be expanded by adding one or more sheds to the quench tower geometry. In addition, as also explained in more detail below, the recovery of particulate matter and steam can also be improved by closing one or more sides of the quench tower. A variety of means may be used to close the one or more sides of the quench tower, including the installation of a barrier such as a door or curtain. A person of ordinary skill in the art will appreciate that any such barrier may be used to cover one or more openings in any number of walls of the quench tower and/or to cover one or more openings in any number of sheds attached to the quench tower.

Closing off more sides of the quench tower improves the particulate matter, emissions, and steam recovery by improving the draft at the sections of the quench tower still open to the atmosphere. The draft of the tower can also be improved to lower the amount of particulate matter, emissions, and steam that escape from the bottom by making the tower taller. In cases where there is still loss of particulate matter, emissions, and steam from the quench tower, a shed can be added above the open areas to funnel the lost particulates, emissions, and steam back into the tower leading to improved overall particulate matter, emissions, and steam recovery. By using sheds, closing off select walls of the quench tower, and varying the quench tower height, the quench tower design can be optimized to give better environmental performance at a lower cost. A shed may have one or more side walls, or may have no side walls. In addition, sheds can be retrofitted to existing quench towers to improve their performance. The performance is improved by enlarging the coverage area effectively corresponding to the existing quench tower height based on the proposed correlations.

The improved quench tower design disclosed herein also includes one or more openings in the quench tower in order to improve the airflow (or "draft distribution") through the quench tower. The one or more openings may be located in a wall, shed, or barrier of the quench tower and preferably are located at an elevation that is lower than the elevation of a train car containing an amount of coke to be quenched. The lower evaluation of the openings allows air to flow into the quench tower from the bottom of the quench tower, where the air then flows in an upward direction through the quench tower. As the air flows upwards through the quench tower, the draft contacts the train car and carries steam and emissions from the train car in an upward direction. As a result, steam and emissions generated during quenching are carried upward through the quench tower—as opposed to escaping from one or more sides of the quench tower—where particulate matter may be trapped from the air by one or more baffles residing in an upper portion of the quench tower, as described more fully below. The improved quench tower also provides reclaim baffles for recapturing flied coke generated during the quenching process. The improved quench tower therefore allows for improved retention of flied coke and overall lower emissions, particulate matter, and steam loss as compared to conventional quenching systems.

Figure 2C:
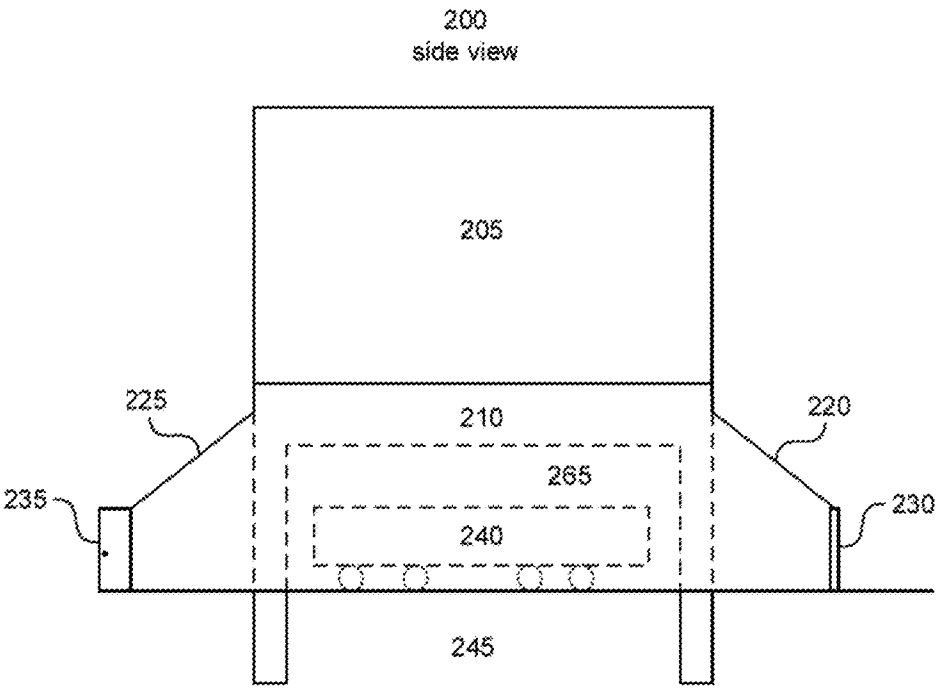
FIG. 2C is a side view of a first embodiment of an improved quench tower as disclosed herein.
Figure 2A:
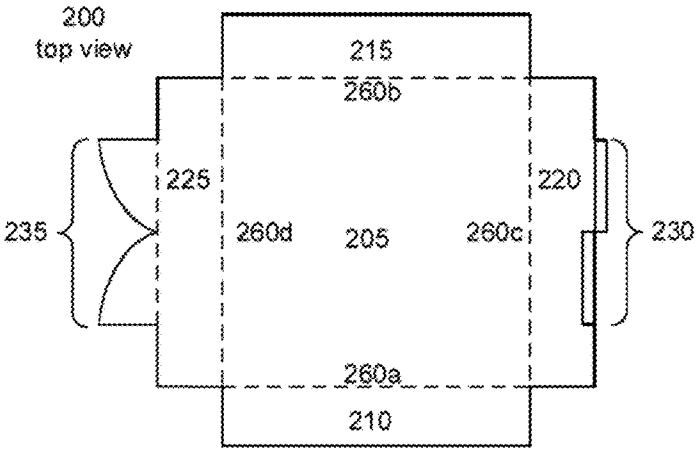
FIG. 2A is a top view of a first embodiment of an improved quench tower as disclosed herein.
Figure 2B:
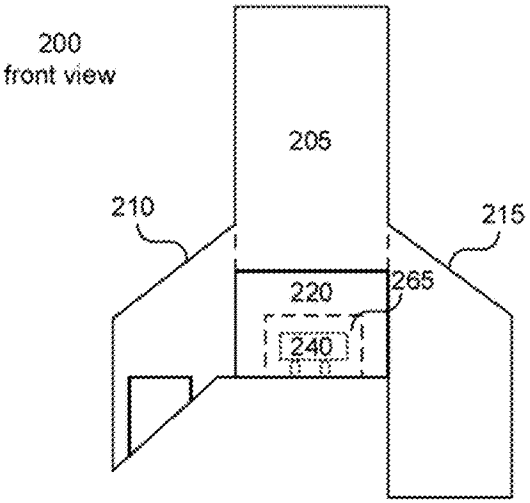
FIG. 2B is a front view of a first embodiment of an improved quench tower as disclosed herein.

FIGS. 2A-2C illustrate a first embodiment of an improved quench tower as disclosed herein. Side walls **260*a*-260*d* are joined together to form the base of quench tower 200. The side walls may be joined together by any available means, including fasteners, adhesives, welded connections, or by any other suitable building construction means known to persons of ordinary skill in the art. In the embodiment of FIGS. 2A-2C, one shed is attached to each side wall of quench tower 200: shed 210 is attached to side wall 260***a*; shed 215 is attached to side wall 260*b*; shed 220 is attached to side wall 260*c*; and shed 225 is attached to side wall 260*d*. In addition, a physical opening exists between each side wall and the respective shed to which each side wall is attached. The physical opening may be created by removing a portion of the side wall to create an area that extends from base portion 205 of the quench tower into the respective shed. For example, a physical opening in side wall 260*a* (not shown) creates an area that extends from base portion 205 into shed 210.

Further, each shed may contain one or more exterior openings that may be used for a variety of purposes, including entry and/or exit of a train car, dumping of coke from a train car, or improving the draft distribution through the quench tower. The exterior opening may be uncovered, fully covered, or partially covered by one or more doors or curtains. One or more doors may be formed of any material suitable to provide partial or full coverage of an exterior opening in the shed, such as wood, metal, or composite material. Furthermore, a door may be of any type suitable to provide partial or full coverage of the exterior opening of the shed, such as a sliding door or a hinged door. The curtain may be formed of metal, fabric, mesh, or any other material that is relatively easily movable and suitable to provide partial or full coverage of an exterior opening of the shed. For example, the curtain may be formed of any material allowing an amount of coke to be emptied out of a quench car without the need to manually operate a door or other barrier. In the case of an opening with a door, curtain or partially covered opening that can have particulate matter, emissions or steam leaking out of the bottom, a shed can be placed over the opening to collect the lost particulate matter, emissions, and steam. The shed may have an opening above the door to allow the collected particulates, emissions, and steam to be fed back into the quench tower leading to improved environmental performance, as discussed in additional detail below in reference to FIG. 7.

As illustrated in the embodiment of FIG. 2C, a train car 240 may enter quench tower 200 through a sliding door 230, continue into shed 220 through the opening revealed by door 230, and continue into the quench tower base 205 through an opening in side wall 260*c*, where the coke in the train car may be quenched as described in more detail below. After quenching, the train car 240 may exit the quench tower 200 through the same path used to enter the quench tower, or the train car may exit the quench tower through a different path. For example, train car 240 may exit the quench tower by traveling through an opening in side wall 260*d* into shed 225, and exiting the shed by traveling through an opening revealed by hinged door 235. Alternatively, for example, the train car may exit the quench tower by traveling through an opening in side wall 260*a* into shed 210, and exiting the shed by traveling though an exterior opening (not shown) in shed 210. As an alternative to a movable barrier such as a door or curtain, the ends of the train car can be made to fill a hole at the end of the quench tower or can be made to fully or partially fill a quench tower opening, thereby eliminating the need for a movable barrier at the filled opening. A person of ordinary skill in the art will recognize that the train car 240 may enter and exit the quench tower 200 through any combination of openings in the quench tower.

One or more surfaces of the quench tower may include any number of openings to increase the amount of particulate matter that is captured by the quench tower. For example, referring to FIG. 3, quench tower 300 contains openings 395*a*-395*b* which are located at an elevation that is lower than train car 370 containing an amount of coke 390. During quenching, the ambient air entrains into the quench tower through openings 395*a*-395*b*, the entrained air flows upward to make contact with train car 370 and an amount of coke 390, and then the entrained air carries particulate matter, steam, and emissions from the coke in an upward direction through the quench tower to be trapped by one or more baffles (e.g., 310 and 305), as described in more detail below. The placement of openings 395*a*-395*b* below train car 370 provides for a significant improvement in particulate matter, emissions, and steam capture and dispersion as compared to openings placed above the train car. For example, when placed above the train car, the entrained air flows upward through the quench tower without first contacting train car 370 and coke 390. As a result, while still effective, a smaller amount of particulate matter from the coke is carried upward through the quench tower to be captured by the baffles. Additionally or alternatively to openings 395*a*-395*b*, one or more openings may be created in the area underneath the tower (i.e., the area between the quench tower and the ground below).

Figure 2F:
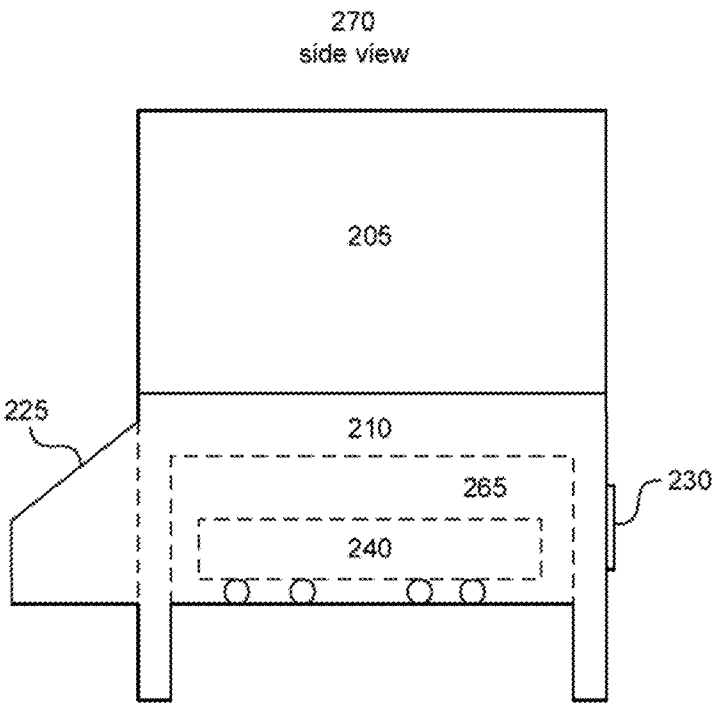
FIG. 2F is a side view of a second embodiment of an improved quench tower as disclosed herein.
Figure 2D:
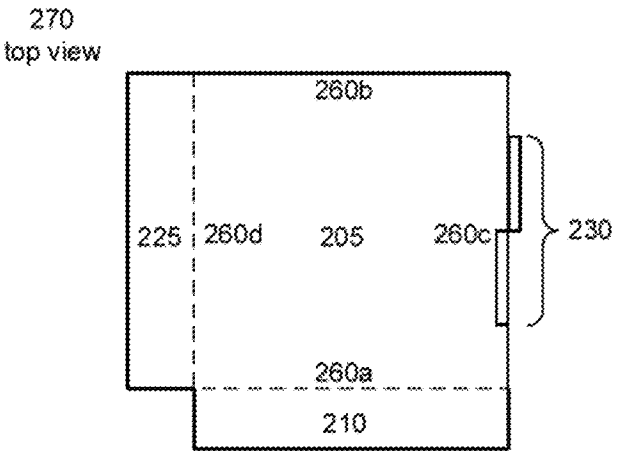
FIG. 2D is a top view of a second embodiment of an improved quench tower as disclosed herein.
Figure 2E:
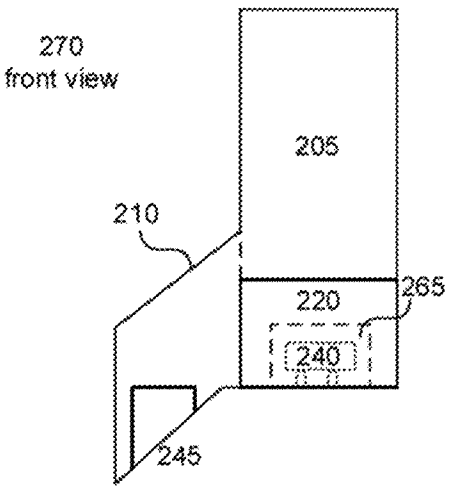
FIG. 2E is a front view of a second embodiment of an improved quench tower as disclosed herein.

FIGS. 2D-2F illustrate a second embodiment of an improved quench tower as disclosed herein. Side walls 260*a*-260*d* are joined together to form the base of quench tower 200. In the embodiment of FIGS. 2D-2F, one shed is attached to each of two side walls of quench tower 200, while the remaining two side walls have no shed attached thereto: shed 210 is attached to side wall 260*a* and shed 225 is attached to side wall 260*d*; side walls 260*b* and 260*c* have no side walls attached. A physical opening exists between side wall 260*a* and shed 210, and a physical opening exists between side wall 260*d* and shed 225. The physical openings may be created by removing a portion of the side wall to create an area that extends from base portion 205 of the quench tower into sheds 210 and 225. As described in reference to the embodiment of FIGS. 2A-2C, the quench tower may include one or more openings located below a train car containing coke in order to improve the draft distribution through the quench tower, thereby resulting in more effective collection of emissions, particulate matter, and steam generated during quenching. Returning to the second embodiment, FIG. 2F illustrates a train car 240 that may enter quench tower 200 through a sliding door 230 and proceed directly into the quench tower base 205, where the coke in the train car may be quenched as described in more detail below. After quenching, the train car 240 may exit the quench tower 200 through the same path used to enter the quench tower or a different path, as described above.

Figure 7:
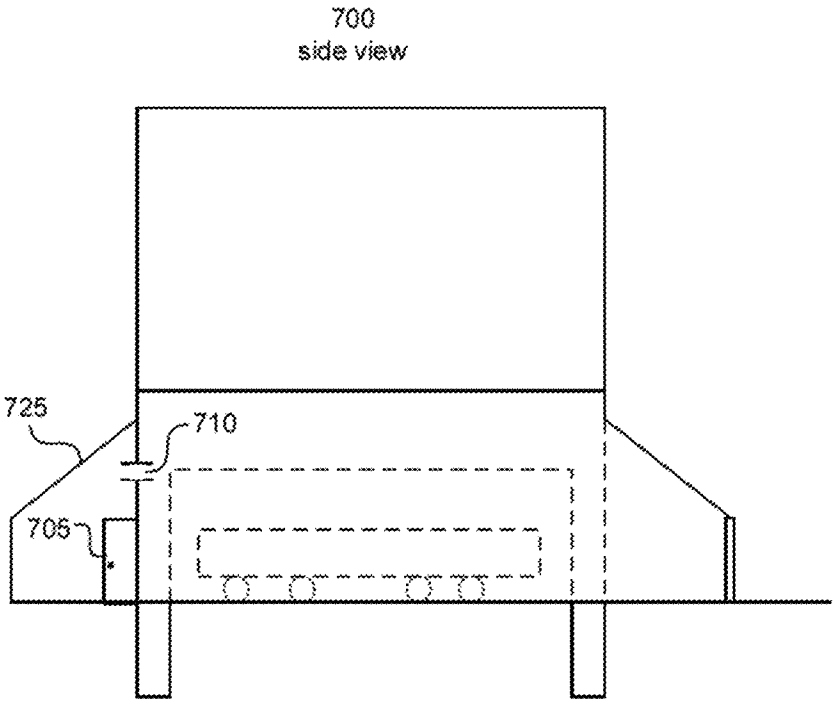
FIG. 7 is a side view of an embodiment of a quench tower having a control opening as disclosed herein.

In the embodiment of FIG. 7, a quench tower 700 includes an attached shed 725 having a door 705. A control opening 710 (e.g., an opening having any shape, including a circle, square, etc.) is created in the portion of the quench tower wall situated underneath or above the shed 725. When steam and/or particulate matter escapes from the sides, top, or bottom of the quench tower door 705, the control opening 710 redirects the escaped steam and/or particulate matter back into the quench tower. A person of ordinary skill in the art will appreciate that one or more control openings may be located in a variety of different positions in the quench tower structure, either in conjunction with a shed or not in conjunction with a shed.

The embodiments described herein are useful for designing new quench towers that are more efficient than current towers, as well as retrofitting existing towers that would benefit from more efficient operations. For example, one or more sheds can be added to an existing tower to improve otherwise poor recovery of steam, particulate matter, and emissions from the bottom of the tower. Moreover, the embodiments are useful to design an optimal quench tower by optimizing the quench tower effective perimeter area, quench tower exit perimeter area, quench tower height, sheds, walls (e.g., used to block bottom openings of the quench tower), doors, and train cars. These optimizations allow the design of a more effective and less costly quench tower (i.e., shorter quench tower) with equivalent or better recovery.

A person of ordinary skill in the art will appreciate that additional embodiments of the quench tower are possible that are consistent with the designs disclosed herein. For example, the quench tower may consist of more than four side walls, may consist of fewer than four side walls, or may take a variety of different physical shapes, including shapes that may be fully or partially curvilinear. A person of ordinary skill in the art will appreciate that the base of the quench tower base may contain any number of sheds, including no sheds, and will further recognize that each shed may or may not contain one or more doors of various types, including door types not specifically disclosed herein. A person of ordinary skill in the art will further appreciate that a train car may enter the quench tower through multiple different openings, may exit the quench tower through multiple different openings, and may enter the quench tower through a same or different opening than used for exiting the quench tower.

As used herein, a quench tower exit perimeter refers to the perimeter at the top of the quench tower defined by a partially open top portion of the quench tower that is defined by the side walls of the quench tower. A quench tower physical perimeter refers to the perimeter at the bottom of the quench tower defined by a partially open top portion of the quench tower that is defined by the side walls of the quench tower. A shed physical perimeter refers to the perimeter defined by one or more outwardly extending surfaces joined to a side wall of the quench tower to create a substantially closed top portion. A quench tower effective perimeter refers to the combination of the quench tower physical perimeter and one or more shed physical perimeters. A train car perimeter refers to the perimeter defined by the sides of a train car. An improved draft distribution or an improved draft distribution profile refers to improved three-dimensional spatial draft distribution within the quench tower effective perimeter that can be actively or passively enhanced by altering the dimensions of the tower or by adding a shed. As discussed herein, one of the benefits of enhancing draft distribution of the quench tower is lowering the loss of particulate matter, emissions and steam from one or more openings in the bottom portion of the quench tower.

Figure 5B:
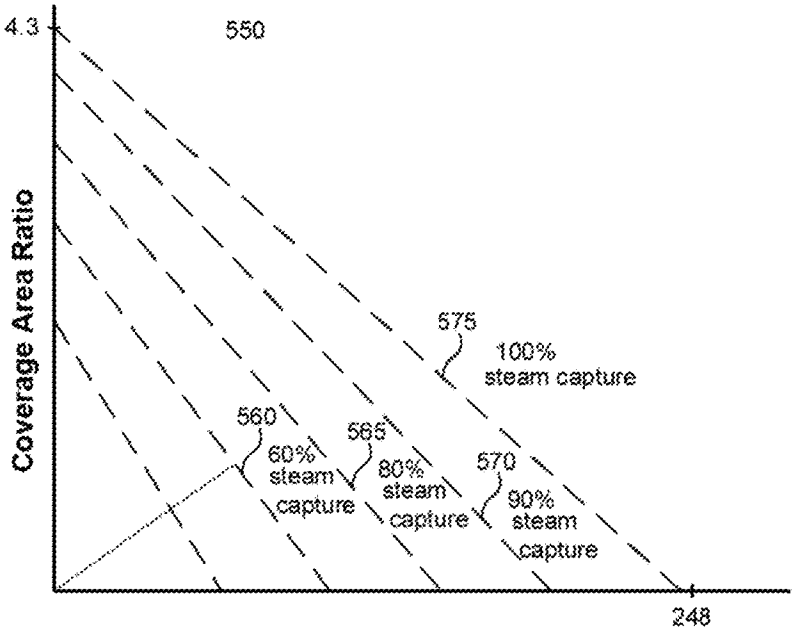
FIG. 5B is an example graph depicting the amount of steam captured in a quench tower as a function of coverage area ratio to tower height according to the embodiment of FIG. 5A.
Figure 5C:
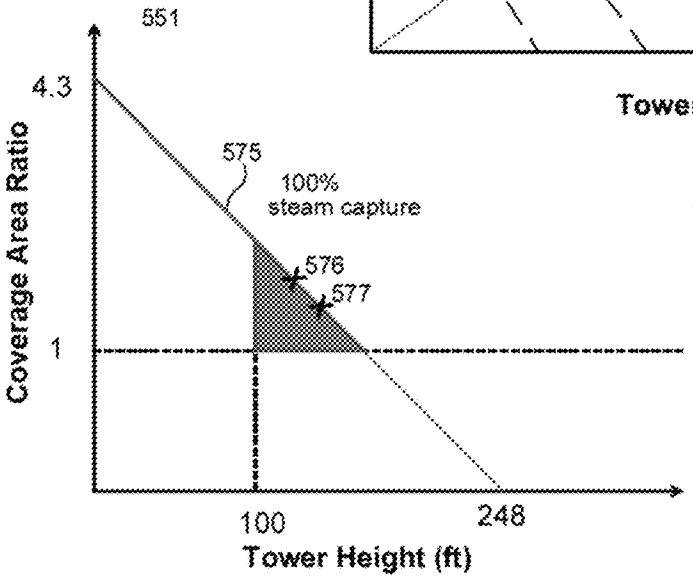
FIG. 5C is an example graph depicting a preferred area to maximize steam capture in a quench tower as a function of coverage area ratio to tower height according to the embodiment of FIG. 5A.
Figure 5A:
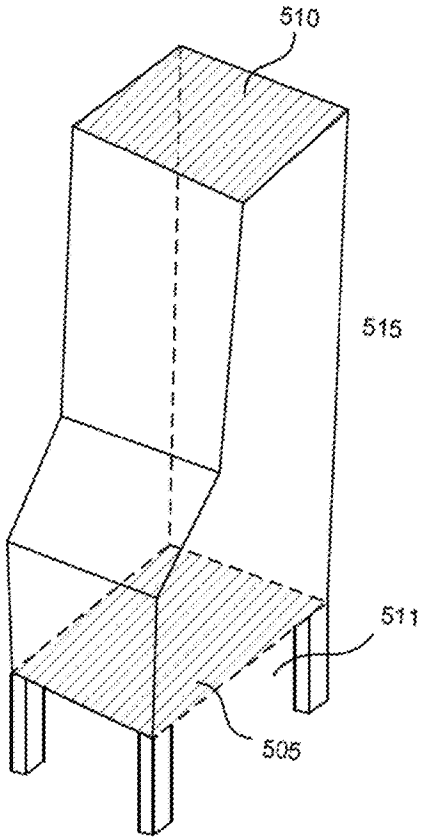
FIG. 5A is a three-dimensional view of a quench tower having a quench tower effective perimeter area, a quench tower exit perimeter area, and a height according to a first embodiment.

The effective perimeter of the quench tower can be enlarged by adding a shed. The performance of the quench tower can be enhanced by adjusting the quench tower effective perimeter (i.e., adding a shed to the quench tower physical perimeter in order to expand the quench tower effective perimeter), adjusting the quench tower exit perimeter at the top of quench tower (e.g., making the quench tower exit perimeter significantly larger than the quench car), and adjusting the height of the quench tower to increase overall draft of the quench tower). FIG. 5A shows a three-dimensional view of a quench tower 500 having a quench tower effective perimeter area 505, a quench tower exit perimeter area 510, and a height 515. The bottom of quench tower 500 is open on all sides (see, for example, opening 511). FIG. 5B is an example graph depicting the amount of steam captured in one embodiment of quench tower 500 as a function of coverage area ratio to tower height. FIG. 5C is an example graph depicting a preferred area to maximize steam capture in the quench tower as a function of coverage area ratio to tower height. Hereinafter, FIGS. 5A-5C will be collectively referred to as FIG. 5.

The coverage area ratio is calculated by dividing the quench tower effective perimeter area by the quench tower exit perimeter area. The percentage of steam captured by the quench tower is then modeled as a graph by plotting the coverage area ratio against the tower height. For example, in the steam capture graph 550, the coverage area ratio is plotted on the y axis and the tower height is plotted on the x axis. In the example of graph 550, a given tower height/coverage area ratio combination that falls on slope 560 would result in steam capture of 60 percent, a given tower height/coverage area ratio combination that falls on slope 565 would result in steam capture of 80 percent, a given tower height/coverage area ratio combination that falls on slope 570 would result in steam capture of 90 percent, and a given tower height/coverage area ratio combination that falls on slope 575 would result in steam capture of 100 percent. The increased steam capture coverage and reduced loss from the bottom of the quench tower are also indicative of lower losses of particulate matter and other emissions from one or more openings in the bottom portion of the quench tower.

The graph 550 therefore demonstrates the relationship between the quench tower effective perimeter area, the quench tower exit perimeter area at the top of the quench tower, and the height of the quench tower as related to the amount of steam captured by the quench tower. For example, a graph such as graph 550 may indicate that a straight quench tower (i.e., a quench tower having a quench tower effective perimeter area that is substantially equal to the quench tower exit perimeter area, thereby resulting in a coverage area ratio equal to 1) may require a height of 250 feet in order to capture 100 percent of steam from the quench tower, while a quench tower with sheds yielding a Coverage Area Ratio of 2.0 would reduce the quench tower height requirement from 250 feet to 130 feet in order to capture 100 percent of steam from the quench tower. Moreover, the graph 551 includes a preferred slope 575 that represents various combinations of coverage area ratio and tower height that result in 100 percent steam capture. For example, according to graph 551, a coverage area ratio of 1.7 and a tower height of 150 feet would yield a 100 percent steam capture rate (as indicated by point 576). Similarly, a coverage area ratio of 1.33 and a tower height of 172 feet would yield a 100 percent steam capture rate (as indicated by point 577).

Figure 6B:
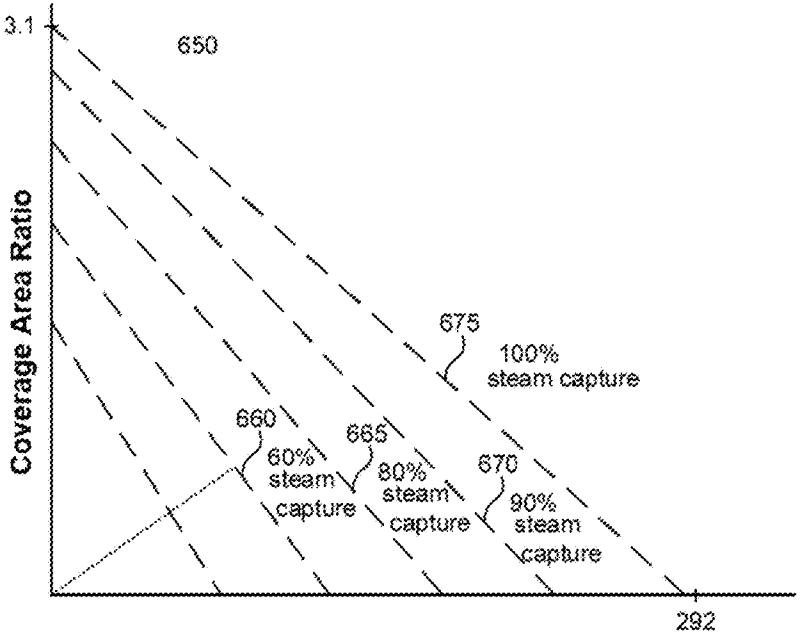
FIG. 6B is an example graph depicting the amount of steam captured in a quench tower as a function of coverage area ratio to tower height according to the embodiment of FIG. 6A.
Figure 6C:
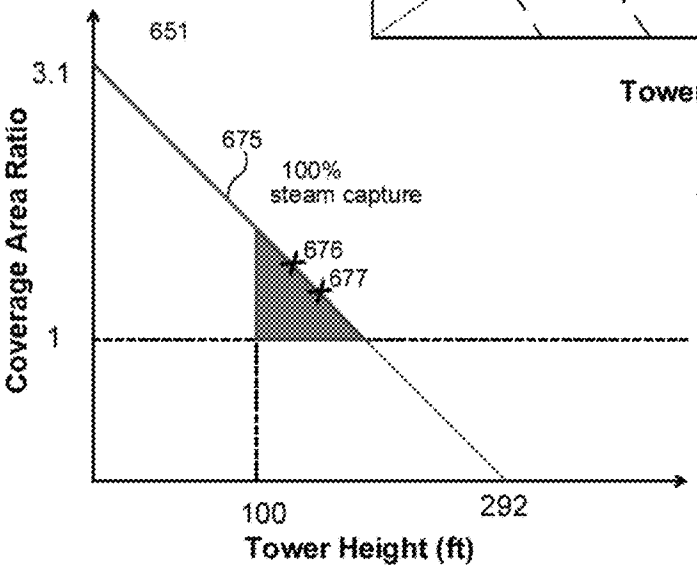
FIG. 6C is an example graph depicting a preferred area to maximize steam capture in a quench tower as a function of coverage area ratio to tower height according to the embodiment of FIG. 6A.
Figure 6A:
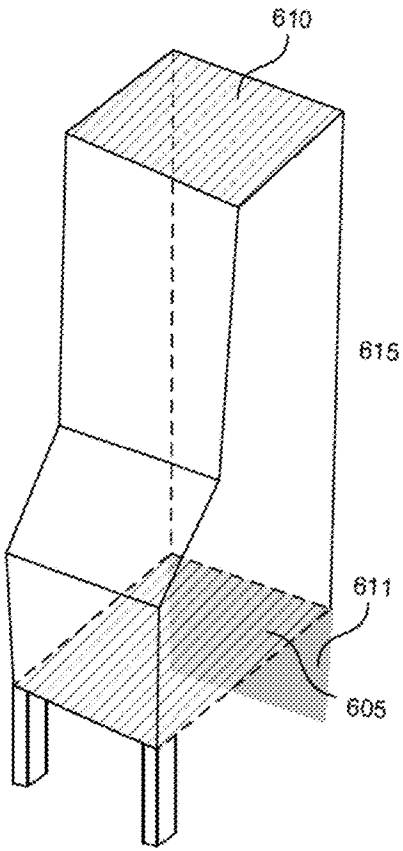
FIG. 6A is a three-dimensional view of a quench tower having a quench tower effective perimeter area, a quench tower exit perimeter area, and a height according to a second embodiment.

The steam capture properties of the quench tower may vary with as one or more sides of the quench tower are opened or closed. FIG. 6A shows a three-dimensional view of a quench tower 600 having a quench tower effective perimeter area 605, a quench tower exit perimeter area 610, and a height 615. The bottom of quench tower 600 is closed on one side 611 and is open on the remaining sides. FIG. 6B is an example graph depicting the amount of steam captured in one embodiment of quench tower 600 as a function of coverage area ratio to tower height. FIG. 6C is an example graph depicting a preferred area to maximize steam capture in the quench tower as a function of coverage area ratio to tower height. Hereinafter, FIGS. 6A-6C will be collectively referred to as FIG. 6. Although specific values and ranges are used with respect to FIGS. 5 and 6, a person of ordinary skill in the art will appreciate that the specific values used are for illustrative purposes only and are not intended to limit the scope of the subject matter disclosed herein.

Graph 651 includes a preferred slope 675 that represents various combinations of coverage area ratio and tower height that result in 100 percent steam capture (as indicated by point 676). For example, according to graph 651, a coverage area ratio of 1.93 and a tower height of 110 feet would yield a 100 percent steam capture rate (as indicated by point 677). Similarly, a coverage area ratio of 1.7 and a tower height of 130 feet would yield a 100 percent steam capture rate.

A person of ordinary skill in the art will recognize that a graph depicting the amount of steam captured in a quench tower as a function of coverage area ratio to tower height, as depicted in FIGS. 5 and 6, may be useful in retrofitting existing quench towers to improve overall performance and efficiency. A person of ordinary skill in the art will also recognize that, although FIGS. 5 and 6 are discussed in terms of steam capture, FIGS. 5 and 6 (and the associated discussion) are equally applicable to the capture of particulate matter and emissions.

Quench Baffle Design and Arrangement

The quench tower design disclosed herein may include one or more quench baffles located inside of the quench tower and situated above a train car containing an amount of coke to be quenched. The quench baffle comprises a plurality of chevrons, each of which may be attached, affixed, mounted, hooked, or otherwise connected to a structure inside of the quench tower. For example, the chevrons of the baffle may be hooked onto a baffle support structure that is mounted to one or more walls of the quench tower. The quench baffle may span substantially the length and/or width of the quench tower exit perimeter area formed by the quench tower side walls, as discussed in more detail below. The chevrons of the baffle are adapted to trap particulate matter to prevent its escape from the quench tower during the quenching process. The one or more chevrons may be formed from a variety of different materials including wood, plastic, metal, steel, or any other material suitable for trapping particulate matter. For example, a wood baffle may be advantageous in some instances because the natural profile of the wood may have a wider profile than other materials, thereby resulting in a path that is more tortuous and able to trap a greater amount of particulate matter. In addition, a wood chevron may be hooked to the quench tower rather than attached to the quench tower. A plastic chevron may be advantageous in some instances because, when statically charged, the plastic material may attract more particulate matter that can then be trapped. Similarly, a steel chevron may be advantageous in some instances because steel may allow for easier construction and/or mounting to the quench tower, and may result in a more tortuous path and a more desirable pressure drop in the tower.

The one or more chevrons may take a variety of shapes, including a single chevron shape or a multi-turn chevron shape. In the case of a single chevron shape, the single chevron is attached or hooked to the quench tower at an angle that provides a surface area that contacts air that flows in an upward direction through the quench tower. As the air contacts the single chevron, particulate matter in the air becomes trapped on the surface area of the chevron, thereby preventing the particulate matter from being vented out of the quench tower and into the surrounding atmosphere external to the quench tower. The ability to trap particulate matter may increase further when multi-turn chevrons are used. In a multi-turn chevron design, two or more chevrons may be located relative to one another at an angle that increases the effective surface area of the chevron.

The increased surface area of the multi-chevron design and the tortuous path through the multi-turn chevron design allow for improved trapping of particulate matter that comes into contact with the chevrons as the air flows upward through the quench tower. The one or more baffles may be sprayed with liquid to pre-wet the baffles prior to quenching in order to increase the trapping capabilities of the baffles. Additionally or alternatively, the one or more baffles may be sprayed with liquid to apply a continuous stream or spray of liquid to the baffles of the chevron during quenching. Additionally or alternatively, the one or more baffles may be sprayed with high pressure liquid to reclaim trapped particulate matter after quenching, as explained in more detail below. A person of ordinary skill in the art will appreciate that the quench tower design may employ a number of additional means to improve the ability of the baffles to trap particulate matter, including for example providing a charged baffle made of plastic or any other material suitable for attracting particulate matter to be trapped.

Figure 3:
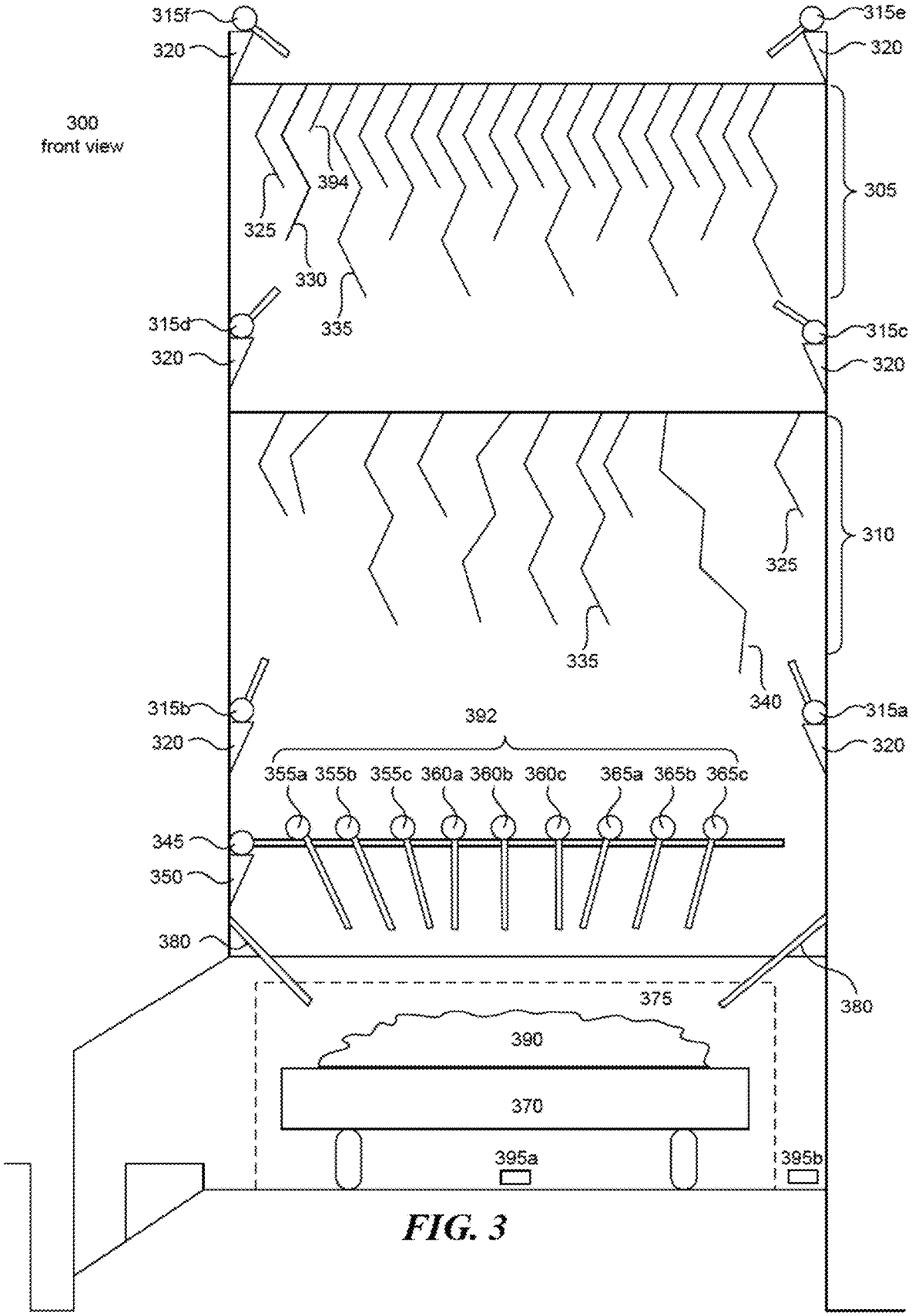
FIG. 3 is a detailed side view showing components of an improved quench tower as disclosed herein.

FIG. 3 illustrates a quench tower design in accordance with embodiments disclosed herein. In particular, quench tower 300 includes a first quench baffle 305 and a second quench baffle 310, each of which extends substantially the width of the opening in the top of the quench tower. Quench baffle 305 includes a plurality of different chevron shapes, including single chevron 394, and multi-turn chevrons 325 (having two turns), 330 (having three turns), and 335 (having four turns). Quench baffle 310 is situated below quench baffle 305 and similarly includes a plurality of different chevron shapes, for example multi-turn chevrons 325 (having two turns), 335 (having four turns), and 340 (having five turns). A person of ordinary skill in the art will appreciate that a chevron may have any number of turns and may be attached or hooked to the quench tower at any angle between zero and 180 degrees with respect to the opening in the quench tower. A person of ordinary skill will further appreciate that each chevron may be separated from a neighboring chevron by a fixed or variable distance. Accordingly, the disclosed baffle design allows flexibility to select a baffle shape and separation distance, as well as a number of baffles used, to maximize the rate of particulate matter capture. For example, one design may include one baffle having chevrons with a large number of turns with relatively small spacing between each chevron (for example, two inches). A different example may include multiple layers of baffles comprising a first baffle having chevrons with a large number of turns with relatively larger spacing between each chevron layered with a second baffle having chevrons with a small number of turns with relatively smaller spacing between each chevron.

Quench Baffle Spray Nozzle Design and Arrangement

The quench baffles disclosed herein may be equipped with one or more quench baffle spray nozzles that may be used to clean the quench baffle (including one or more chevrons comprising the quench baffle), wet the quench baffle prior to quenching in order to increase the amount of particulate matter that may be trapped during quenching, dislodge trapped particulate matter from the quench baffle after quenching for recapture, as described above, and/or suppress dust generated during quenching, as described in more detail below. The quench baffle spray nozzles may be mounted in a variety of positions within the quench tower. In one embodiment, a quench baffle spray nozzle may be located on the interior of the quench tower in a position that is situated above at least one quench baffle. If situated above a quench baffle, the quench baffle spray nozzle may be angled in a downward direction in order to dispose an amount of liquid onto the quench baffle below or towards a mass of coke below. In another embodiment, a quench baffle spray nozzle may be located on the interior of the quench tower in a position that is situated below at least one quench baffle. If situated below a quench baffle, the quench baffle spray nozzle may be angled in an upward direction in order to dispose an amount of liquid onto the quench baffle above.

In another embodiment, a quench baffle spray nozzle may be located on the interior of the quench tower between two quench baffles. If situated between two quench baffles, the quench baffle spray nozzle may be angled in an upward direction in order to dispose an amount of liquid onto the quench baffle above or may be angled in a downward direction in order to dispose an amount of liquid onto the quench baffle below or towards a mass of coke below. Additionally, the nozzle may employ a mechanism allowing the angle to be adjusted upward or downward in order to service either the above baffle or the below baffle (as well as the dust generated from quenching the mass of coke below), as needed. In still another embodiment, a quench baffle spray nozzle may be located on the exterior of the quench tower and angled in a downward direction in order to dispose an amount of liquid onto one or more quench baffles located inside of the quench tower as well as to suppress an amount of dust that is generated before and during quenching. A person of ordinary skill in the art will appreciate that the one or more quench baffle spray nozzles dispose a stream or spray of liquid that is either pressurized or unpressurized. A person of ordinary skill in the art will further appreciate that the one or more quench baffle spray nozzles may dispose a variety of liquids, including water, a cleaning solution, a protective sealant, or any other liquid (or combination thereof) suitable for cleaning the quench baffle, removing particulate matter from the quench baffle, or protecting the materials of the quench baffle. A person of ordinary skill in the art will further appreciate that the one or more quench baffle spray nozzles may dispose the one or more liquids in a continuous intermittent stream or spray.

FIG. 3 illustrates a quench baffle spray design and arrangement in accordance with embodiments of the technology disclosed herein. A first set of baffle spray nozzles 315*a* and 315*b* are located inside of quench tower 300 below quench baffle 310. As illustrated in FIG. 3, baffle spray nozzles 315*a* and 315*b* are connected to quench tower 300 via mounts 320 and are angled in an upward direction towards quench baffle 310. Baffle spray nozzles 315*a* and/or 315*b* may dispose an amount of liquid onto quench baffle 310 for a variety of different purposes, including wetting, cleaning, or protecting one or more quench baffles, as described above. Baffle spray nozzles 315*a* and/or 315*b* (or a different set of baffles (not shown)) may also be used to knock down particulate matter (including small or large particulate matter) that is generated during quenching. A second set of baffle spray nozzles 315*c* and 315*d* are located inside of quench tower 300 between quench baffles 305 and 310. As illustrated, in FIG. 3, baffle spray nozzles 315*c* and/or 315*d* may be angled in an upward direction towards quench baffle 305 in order to dispose an amount of liquid onto quench baffle 305. Alternatively, baffle spray nozzles 315*c* and/or 315*d* may be angled in a downward direction towards quench baffle 310 in order to dispose an amount of liquid onto quench baffle 310. A third set of baffle spray nozzles 315*e* and 315*f* are located on the exterior of quench tower 300 above quench baffle 305. As illustrated in FIG. 3, baffle spray nozzles 315*e* and 315*f* are angled in a downward direction towards quench baffle 305 and may dispose an amount of liquid onto quench baffle 305 for a variety of different purposes, including wetting, cleaning, or protecting one or more quench baffles, and dust suppression, as described above.

A person of ordinary skill in the art will appreciate that a greater or smaller number of baffle spray nozzles may be used. For example the quench tower may contain only a single baffle spray nozzle or may contain multiple sets of baffle spray nozzles. A person of ordinary skill will further appreciate that the one or more baffle spray nozzles may be angled in different directions. For example, baffle spray nozzle 315*c* may be angled in a downward direction at the same time that baffle spray nozzle 315*d* is angled in an upward direction. A person of ordinary skill in the art will appreciate that one or more baffle spray nozzles may be dedicated to different functions. For example, one set of baffle spray nozzles may be dedicated to cleaning the baffle, a different set of baffle spray nozzles may be dedicated to wetting the baffle, and still a different set of baffle spray nozzles may be dedicated to dust suppression. A person of ordinary skill in the art will further appreciate that one or more baffle spray nozzles may deliver a pressurized stream or spray of liquid while one or more different baffle spray nozzles may deliver an unpressurized stream or spray of liquid. A person of ordinary skill in the art will appreciate that the pressure and/or type of baffle spray nozzle may be changed in accordance with the type of particulate matter to be removed from the baffles. For example, a larger nozzle with higher pressure may be used to remove relatively large particulate matter from one or more baffles, while a smaller nozzle with lower pressure may be used to remove relatively small particulate matter from one or more baffles. A person of ordinary skill in the art will further appreciate that the one or more baffle spray nozzles may dispose a different type of liquid onto a respective quench baffle, including water, a cleaning solution, a protective sealant, or any other liquid (or combination thereof) suitable for cleaning the quench baffle, removing particulate matter from the quench baffle, or protecting the materials of the quench baffle. A person of ordinary skill in the art will further appreciate that the one or more baffle spray nozzles may dispose the different types of liquids in a continuous intermittent stream or spray.

Quench Nozzle Design and Arrangement

The improved quench tower disclosed herein includes one or more quench spray nozzles adapted to dispose an amount of liquid onto a mass of coke to be quenched. The one or more quench spray nozzles may be mounted in the interior of the quench tower in a position located above the mass of coke to be quenched. The quench spray nozzles may be coupled together at various angles to form a quench spray nozzle array. For example, one or more of the quench nozzles may be oriented to dispose an amount of liquid onto the mass of coke at an angle of between zero and 90 degrees with respect to a first or second side of the mass of coke, while one or more additional quench nozzles may be oriented to dispose an amount of liquid onto the mass of coke in a generally downward direction at an angle roughly perpendicular to the mass of coke.

Moreover, the one or more quench nozzles may be situated to dispose the amount of liquid onto different portions of the mass of coke. For example, one or more nozzles may be situated to dispose an amount of liquid onto a center region of the mass of coke, a different one or more nozzles may be situated to dispose an amount of liquid onto one edge of the mass of coke, and/or one or more nozzles may be situated to dispose an amount of liquid onto the opposite edge of the mass of coke. During quenching, the one or more nozzles may be fired in stages to optimize the quenching process. For example, one or more nozzles may dispose an amount of liquid onto the side regions of the mass of coke during an initial quenching stage, while a different one or more nozzles may dispose an amount of liquid onto the center region of the mass of coke during a subsequent quenching stage. A person of ordinary skill in the art will appreciate that the quenching process may include any number of quenching stages and that individual quench nozzles or groups of quench nozzles may be active during all or fewer than all of the quenching stages. In addition, each quench nozzle may be tuned in order to control the location, the amount of liquid disposed, and the firing of the individual nozzle.

FIG. 3 illustrates a quench tower 300 having a quench spray nozzle array 392 in accordance with embodiments disclosed herein. Quench spray nozzle array 392 includes quench spray nozzles 355*a*-355*c*, 360*a*-360*c*, and 365*a*-365*c*, which are located above a train car 370 containing a mass of coke to be quenched. Quench spray nozzles 355*a*-355*c* and 365*a*-365*c* are oriented to dispose an amount of liquid onto the mass of coke at an angle of between zero and 90 degrees with respect to a first side (e.g., the left side) of the mass of coke or a second side (e.g., the right side) of the mass of coke. Quench spray nozzles 360*a*-360*c* are oriented at an angle roughly perpendicular to the mass of coke in order to dispose an amount of liquid onto the mass of coke. Quench spray nozzles 360*a*-360*c* are adapted to dispose an amount of liquid on the center region of the coke to be quenched, quench spray nozzles 355*a*-355*c* are adapted to dispose an amount of liquid on the left region of the coke to be quenched, and quench spray nozzles 365*a*-365*c* are adapted to dispose an amount of liquid on the right region of the coke to be quenched. As discussed above, the one or more quench nozzles may be fired in phases to achieve more efficient quenching. For example, quench spray nozzles 355*a*-355*c* and 365*a*-365*c* may be active during a first phase of the quenching process, while quench spray nozzles 360*a*-360*c* may be active during a subsequent phase of the quenching process. In addition, the quench spray nozzles may be pressurized differently to meet coke quench needs or to further break an intact amount of coke. A person of ordinary skill in the art will appreciate that, in addition to quench spray nozzle array 392, one or more additional nozzle arrays (not shown) may be located within the quench tower above a mass of coke. The one or more additional nozzle arrays may be adapted to perform a variety of different purposes, including quenching the mass of coke or suppressing an amount of dust generated during the quenching process.

Example Quench Procedure

Figure 4:
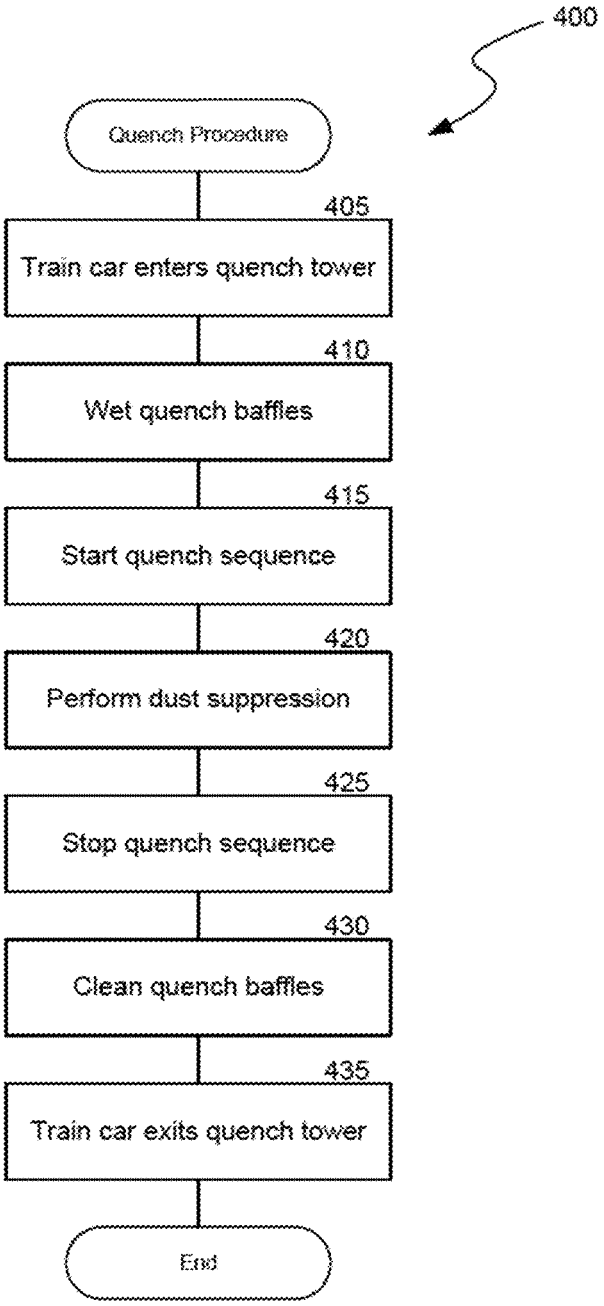
FIG. 4 is a flow diagram of an embodiment of a quenching procedure as disclosed herein.

FIG. 4 illustrates an example quench procedure 400 in accordance with the embodiments disclosed herein. At block 405, a quench car containing an amount of coke to be quenched enters the quench tower 300. At step 410, one or more baffle spray nozzles wets the quench baffles by disposing an amount of liquid onto the quench baffles in order to increase the efficiency of particulate matter removal during the quenching process. At step 415, the quenching sequence is started. The quenching sequence may include, for example, a first phase that disposes an amount of liquid on both edges of the amount of coke to be quenched by firing quench nozzles 355*a*-355*c* and 365*a*-355*c* while not firing quench nozzles 360*a*-360*c*. At the conclusion of the first quenching phase, quench nozzles 355*a*-355*c* and 365*a*-355*c* may be turned off, and quench nozzles 360*a*-360*b* may be fired to dispose an amount of liquid onto the center region of the amount of coke to be quenched, or vice versa. A person of ordinary skill will appreciate that the quenching sequence may include any number of individual phases.

While the quenching sequence is in progress—particularly towards the beginning of the quenching sequence—a dust suppression feature may be performed at step 420. The dust suppression feature fires one or more baffle spray nozzles before or during the quenching process in order to suppress dust or particulate matter that may rise from the mass of coke (before the quenching process, during the quenching process, or as a result of a delay in the quenching process) by knocking down particulate matter and dust in the air. The dust suppression feature may be activated towards the beginning of the quenching process and may be deactivated before quenching is completed at step 425. For example, the dust suppression feature may be activated during the first 10 seconds of the quenching process (when a plume of particulate matter typically rises from the coke being quenched), although a person of ordinary skill will recognize that the dust suppression period may last for a longer or shorter period of time during quenching. A person of ordinary skill also will recognize that one or more quench baffle spray nozzles may continue to wet one or more baffles (as discussed in reference to step 410) during the dust suppression period to increase the amount of particulate matter that is captured during quenching. After the quenching sequence has completed at step 425, the quench baffles are cleaned via the baffle spray nozzles, as described above. At step 435, the train car containing the quenched coke may exit the quench tower.

During the quenching process, an amount of flied coke and/or reclaimed coke may be directed back into the train car via one or more reclaim baffles 380 that are attached to an interior surface of the quench tower above the train car containing the coke to be quenched. The one or more reclaim baffles may be sloped downward such that any flied coke or reclaimed coke coming into contact with the reclaim baffles is redirected into the train car.

A person of ordinary skill in the art will appreciate that the steps of the quenching procedure may be performed in the same order or a different order than depicted in the flow diagram of FIG. 4 and as described herein. A person of ordinary skill in the art will further appreciate that two or more of the steps of the illustrated quenching procedure may be performed in parallel. For example, wetting the quench baffles (step 410) may occur either before or after the train car enters the quench tower (step 405) or may occur during the quench (e.g., steps 415-425). As another example, the train car may exit the quench tower (step 435) either before or after the quench baffles are cleaned (step 430). As yet another example, the quench baffles may be cleaned (step 430) at the same time that the train car exits the quench tower (step 435).

Various aspects of the quenching procedure may be automated or optimized through the use of one or more sensors and/or input devices located in or around the quench tower and coupled to the quench tower control logic. For example, quenching parameters such as the oven number, coke tonnage, and/or coke size (e.g., height, width, or thickness of the mass of coke) may be fed into the control logic at the start of the quench process, either automatically via one or more sensors or weight scales, or by manual input on a device such as a key entry pad. After the coke enters the quench tower, the one or more sensors in or around the quench tower may automatically activate one or more spray nozzles (i.e., baffle spray nozzles, quench spray nozzles, dust suppression spray nozzles, or any other nozzles of the quench tower) to wet the quench baffles, to spray mist inside of the quench tower to suppress dust or smoke, or to perform a variety of different functions as described herein.

During quenching, the quench tower control logic may use the stored quenching parameters (e.g., oven number, coke tonnage, and/or size of the coke loaf) to adjust a quenching load profile that affects the quench valves in order to deliver a certain amount of quench liquid to the quench nozzle. In addition, the quench tower control logic may adjust the quenching load profile based on a quench tower profile that corresponds to one or more quenching characteristics of the quench tower (e.g., a tendency of the quench tower to quench a mass of coke for a period of time that is either too long or too short.) Additionally or alternatively, the quench nozzle control logic may use the stored or other available information to implement a different quenching sequence to ensure that the hot coke mass is cooled uniformly and to further ensure that the amount of moisture in the coke is maintained below a target range. Additional sensing systems located in or around the quench tower, such as infrared camera systems or thermocouple arrays, may be coupled to one or more secondary quench systems operable to further automatically or manually dispose an amount of quenching liquid onto the coke to reduce the temperature of one or more hot spots in the coke. The additional sensing systems also may be used to provide feedback to the quench tower control logic to adjust the quenching liquid for optimization of the current quench and/or future quenches. The quench tower profile may be updated in accordance with information collected by the sensing system during or after quenching. For example, if the sensing system detects that the duration of the quenching procedure was too long or too short for the amount of coke being quenched, the sensing system may update the quench tower profile to bias future quenching load profiles towards a longer or shorter quench duration, as appropriate. Additional sensing systems located outside of the quench tower may further monitor broken coke temperature and automatically or manually quench the broken coke (e.g., with a liquid cannon such as a water cannon) to cool any remaining hot spots identified by the sensing system. A person of ordinary skill will appreciate that the additional sensing system may quench the broken coke from a source (e.g., a liquid cannon such as a water cannon) that is located anywhere outside of the quench tower, such as a wharf or coke belt associated with the quench tower. For example, the source may be a spray array located above the wharf or coke belt, where one or more different sprays in the array may fire to quench one or more hot sections of the coke.

A person of ordinary skill will recognize that additional automations may be provided by the quench tower control logic. For example, the quench tower control logic may sense an amount of time that has elapsed since a mass of coke entered a quench tower. If the quench procedure for the mass of coke does not start within a predetermined amount of time, the quench tower control logic may automatically activate one or more spray nozzles to dispose an amount of liquid onto the mass of coke. Alternatively or additionally, if the baffles of the quench tower are not wet within a predetermined amount of time after the coke enters the quench tower, the quench tower control logic may automatically activate one or more baffle spray nozzles to cool down the quench tower structure. For example, if quenching does not begin within five minutes of a mass of coke entering the quench tower, then the quench tower control logic may activate a series of quench spray nozzles and dust suppression nozzles to automatically begin the quenching process.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A method for quenching coke in a quench tower, comprising:

receiving a train car containing an amount of coke to be quenched, wherein the train car includes a train car perimeter, defined by a plurality of sides joined together to form the train car, and is received through an opening in an end wall in the quench tower; the quench tower formed from a plurality of side walls and end walls joined together to create a partially open top portion that defines a quench tower physical perimeter that surrounds an area of the partially open top portion of the quench tower;

allowing air to flow into the quench tower through an opening in a bottom portion of at least one side wall, up through the quench tower and out the open top portion;

starting a suppression action to suppress an amount of dust, wherein the suppressing action comprises disposing an amount of liquid in the quench tower via one or more baffle spray nozzles, which knocks down dust rising in air within the quench tower;

starting a quenching action to quench the amount of coke in the train car, wherein starting the quenching action comprises disposing an amount of liquid onto the amount of coke using one or more quench spray nozzles;

managing steam and particulate material, produced by the quenching action, within a quench tower effective perimeter and a quench tower effective perimeter area, which is defined by a combination of the quench tower physical perimeter and a shed physical perimeter; the shed physical perimeter defined by one or more sheds, formed from one or more outwardly extending surfaces joined to a side wall of the quench tower, that create a substantially closed top portion; wherein:

the quench tower effective perimeter is larger than the quench tower physical perimeter;

the quench tower physical perimeter is larger than or equal to a train car perimeter, the train car perimeter being defined by a plurality of sides joined together to form the train car; and the quench tower effective perimeter is configured to provide an enhanced draft distribution profile that reduces expulsion of steam and particulate material from the effective perimeter;

stopping the suppression action, wherein stopping the suppression action comprises discontinuing disposing an amount of liquid in the quench tower via one or more baffle spray nozzles;

stopping the quenching action, wherein stopping the quenching action comprises discontinuing disposing an amount of liquid onto the amount of coke using the one or more quench spray nozzles; and transporting the train car out of the quench tower, wherein the train car is transported through an opening in an end wall in the quench tower.

2. The method of claim 1, wherein the train car is received through a first end wall opening and transported out of a second end wall opening.

3. The method of claim 1, wherein the train car is received through, and transported out of, the same end wall opening.

4. The method of claim 2, wherein at least one of the first end wall opening or the second end wall opening is located in a front section or back section of the quench tower.

5. The method of claim 2, wherein:

at least one of the first end wall opening or the second end wall opening contains a movable barrier coupled thereto that at least partially covers the opening to limit the passage of airflow from within the quench tower through at least one of the first end wall opening or the second end wall opening.

6. The method of claim 5, wherein the movable barrier is a door or curtain.

7. The method of claim 1, further comprising wetting one or more baffles in the quench tower by disposing an amount of liquid onto the one or more baffles, the one or more baffles being attached to an interior surface of the quench tower, and the wetting taking place before the suppression action or the quenching action is started.

8. The method of claim 1, further comprising wetting one or more baffles in the quench tower by disposing an amount of liquid onto the one or more baffles for a duration of time, the one or more baffles being attached to an interior surface of the quench tower, the duration of time lasting from at least the start of the suppression action to the stop of the suppression action or lasting from at least the start of the quenching action to the stop of the quenching action.

9. The method of claim 1, wherein at least one of the one or more quench spray nozzles begins disposing an amount of liquid onto the amount of coke before a different at least one of the one or more quench spray nozzles begins disposing an amount of liquid onto the amount of coke.

10. The method of claim 1, wherein at least one of the one or more quench spray nozzles stops disposing an amount of liquid onto the amount of coke before a different at least one of the one or more quench spray nozzles stops disposing an amount of liquid onto the amount of coke.

11. The method of claim 1, wherein at least one of the one or more quench spray nozzles disposes an amount of liquid onto a center area of the mass of coke to be quenched or an area that is not a center area of the mass of coke to be quenched.

12. The method of claim 1, further comprising cleaning one or more tower baffles, wherein the cleaning comprises delivering a stream or spray of liquid onto one or more tower baffles using a tower baffle spray nozzle.

13. The method of claim 12, wherein the train car is transported out of the quench tower before or after the baffles are cleaned.

14. The method of claim 1, wherein the quenching action and the suppression action are started simultaneously.

15. The method of claim 1, wherein the quenching action and the suppression action are started at different times.

16. The method of claim 1, wherein the quenching action and the suppression action are stopped simultaneously.

17. The method of claim 1, wherein the quenching action and the suppression action are stopped at different times.

* * * * *